US007167136B2

(12) United States Patent
Thudor et al.

(10) Patent No.: US 7,167,136 B2
(45) Date of Patent: Jan. 23, 2007

(54) WIDEBAND OMNIDIRECTIONAL RADIATING DEVICE

(75) Inventors: Franck Thudor, Rennes (FR); Francoise Le Bolzer, Rennes (FR); Philippe Minard, Saint Medard sur Ille (FR)

(73) Assignee: Thomson Licensing, Boulogna-Billancourt (FR)

( * ) Notice: Subject to any disclaimer, the term of this patent is extended or adjusted under 35 U.S.C. 154(b) by 0 days.

(21) Appl. No.: 11/180,107

(22) Filed: Jul. 13, 2006

(65) Prior Publication Data

US 2006/0012536 A1 Jan. 19, 2006

(30) Foreign Application Priority Data

Jul. 13, 2004 (FR) ..... 04 51506

(51) Int. Cl.
*H01Q 13/10* (2006.01)

(52) U.S. Cl. ..... 343/770; 343/767

(58) Field of Classification Search ..... 343/767, 343/770, 700 MS, 769, 768
See application file for complete search history.

(56) References Cited

U.S. PATENT DOCUMENTS 6,034,694 A * 3/2000 Evans et al. ..... 345/629
6,246,377 B1 6/2001 Aiello et al.
6,292,153 B1 * 9/2001 Aiello et al. ..... 343/767
6,538,614 B1 * 3/2003 Fleming et al. ..... 343/767
7,057,569 B1 * 6/2006 Isoifovich et al. ..... 343/770

FOREIGN PATENT DOCUMENTS

EP 0 685 901 A2 12/1995
EP 1 251 587 A1 10/2002
EP 1 267 446 A1 12/2002

OTHER PUBLICATIONS

Search report dated Feb. 16, 2005.

* cited by examiner

*Primary Examiner*—Hoanganh Le
(74) *Attorney, Agent, or Firm*—Joseph J. Laks; Robert D. Shedd; Brian J. Cromarty

(57) ABSTRACT

The present invention relates to a radiating device intended to receive and/or transmit electromagnetic signals comprising at least two antennas connected by slot and having a common slot. Connection means enable at least one antenna to be connected to processing means of electromagnetic signals. The connection means include two connection lines connected to the processing means. The two lines are terminated by an open circuit and are coupled electromagnetically to the common slot of the two antennas so as to enable a phase difference to be introduced between the electromagnetic signals of the two antennas when the connection is switched from one line to the other by means of a switching device present on the connection lines.

11 Claims, 6 Drawing Sheets

WIDEBAND OMNIDIRECTIONAL RADIATING DEVICE

This application claims the benefit, under 35 U.S.C. § 119 of French Patent Application 0451506, filed Jul. 13, 2004.

The present invention relates to a radiating device intended to receive and/or emit electromagnetic signals comprising at least two means for receiving and/or transmitting electromagnetic signals of the slot connected antenna type and, more particularly, these antennas having a common slot and a connection means for connecting at least one of the said reception and/or transmission means to means for processing electromagnetic signals.

BACKGROUND OF THE INVENTION

In the field of "indoor" communications, wireless links are required to connect different devices in a house. For this, means for receiving and/or transmitting electromagnetic signals, or antennas, of the end-fire tapered slot type are used. Such antennas mainly constituted by a tapered slot realised on a metallic substrate are commonly called Vivaldi antennas or LTSA (Linear Tapered Slot Antenna). They can be integrated more easily into the devices because they radiate in the plane of the substrate. When several antennas of this type are used, for example in a network, the connection of the radiating device rapidly becomes complex.

The dimensioning of a Vivaldi antenna is well-known by those in the profession. It can be divided into three parts shown in FIG. 1, which are the dimensioning of the antenna A1 (Vivaldi profile), the dimensioning of the connection line 2 linked to a connection port P and the dimensioning of the line 2/slot F1 transition that enables the energy of line 2 to be transmitted to the antenna A1. To ensure the correct coupling of energy between the line 2 and the slot F1, it is necessary to obtain a position in specific geometrical conditions concerning the relative positions of the connection lines 2 and the slots F1 of the antennas A1. An example is given, for example, in the document U.S. Pat. No. 6,246,377.

There are two techniques for placing Vivaldi antennas A1 and A2 in a network. A first technique, shown in FIG. 2, involves connecting them in series by the same line 2. The length of line between the two line 2/slot F transitions determines the phase difference between the signals transmitted or received by two successive antennas A1 and A2. By taking an odd multiple of line length of the guided half-wavelength under the connection line realized for example according to the microstrip line technique, namely $L=nLm/2$ ($n=2k+1$, with k an integer), the transmitted fields E1 and E2 are symmetrical with respect to the axis of symmetry of the two antennas A1 and A2. For such a connection in series, the coupling to the antennas A1 and A2 is different from the point of view of the amplitude and the frequency phase difference. This is due to different line lengths between a connection port P and each of the antennas A1 and A2.

A second technique, shown in FIG. 3, consists of connecting them in parallel. The difference in length between L1 and L2 enables the phase difference between the transmitted fields E1 and E2 to be determined. By taking equal lengths, or such that $|L1-L2|=n*Lm$ (where n is an integer), the transmitted fields E1 and E2 are as shown in FIG. 3. This connection technique gives a balanced connection but requires a more complex connection circuit. In particular, if the number of antennas increases, the dimensions of the connection network increase and its implementation sometimes requires the use of components. The cost of the structure consequently increases.

One solution, presented in document EP 0,301,216, is to replace the two line/slot transitions by a single line 2/slot FC transition by connecting the two slots together as shown in FIG. 4. There is therefore only a single line 2/slot FC transition and the slot FC terminates in an antenna, A1 and A2, at each of its two extremities. The coupled energy of the line 2 to the slot FC, is directed equally to the antennas A1 and A2.

However, such a radiating device has a fixed radiation pattern possessing, in particular, a null in the axis of symmetry of the antennas when the line 2 cuts the slot at an equal distance of A1 and A2. Such characteristics can prove to be very damaging within the framework of applications that require great isotropy in the radiating device.

BRIEF SUMMARY OF THE INVENTION

The present invention proposes a radiating device presenting a radiation pattern that can be reconfigured dynamically with a simple connection.

The present invention relates to a radiating device as described in the introduction section in which the connection means include two connection lines connected to processing means, the two lines terminated by an open circuit being coupled electromagnetically with the common slot of the two means of reception and/or transmission so as to enable a phase difference to be introduced between the electromagnetic signals of the two means of reception and/or transmission when the connection is switched from one line to the other using at least a switching device present on the connection lines.

Indeed, the common connection allowed by two lines coupled to a slot common to two antennas enables the radiation pattern of the radiating device to be modulated by switching from one line to the other.

According to one embodiment, the means of reception and/or transmission are grouped in pairs with a common slot, the connection of each pair being realised using two lines placed so as to cut the common slot at different distances from the axis of symmetry of the pair of means of reception and/or transmission so as to introduce a phase difference between the means of reception and/or transmission of the pair.

In this case, one line is, for example, centred on the axis of symmetry of the antennas and the other is offset by a quarter of the wavelength. A phase difference of 180° is then introduced between the signals transmitted by the two antennas of the pair. Hence, the radiation pattern no longer has any null points in the axis.

According to one embodiment, the pairs are grouped by groups of two pairs connected by the same two connection lines, a fixed phase difference having been introduced on one of the lines for the connection of one of the two pairs.

This embodiment enables, for example, four antennas to be controlled with two lines. For example, the fixed phase difference is 180°.

According to one embodiment, the means of reception and/or transmission are grouped in groups of N means of reception and/or transmission by connecting the N slots in a common slot having N branches, connection lines, isolated from each other, forming N' branches centred on the common slot and arranged in an offset manner in rotation with respect to the branches of the common slot.

The embodiment enables a simplified connection of many antennas. It can, for example, be advantageously used in a multi-layer substrate where each line occupies a separate plane.

It is advantageous to choose an even number N. It is also advantageous to choose N'=N. In this manner, the rotation shift is such that the lines are each inserted in each angular sector formed between the branches of the common slot.

According to one embodiment, the means of reception and/or transmission are Vivaldi type antennas evenly spaced around a central point.

Such antennas are commonly used and well known by those in the profession. The invention is advantageously realised with these antennas but can also be realised by any type of antennas connected by a line/slot transition, for example printed dipoles, LTSA (Linear Tapered Slot Antenna) devices.

According to one embodiment, the connection lines are constituted by microstrip lines or coplanar lines.

According to one embodiment, the switching device includes at least one diode.

According to another embodiment, the switching device includes a discrete switch for selectively activating one connection line or the other.

BRIEF DESCRIPTION OF THE DRAWINGS

Other characteristics and advantages of the present invention will emerge on reading the description of different embodiments, the description being made with reference to the annexed drawings wherein.

DESCRIPTION OF PREFERRED EMBODIMENTS

Figure 1:
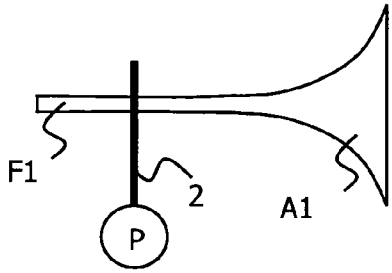
FIG. 1 is a block diagram view of the connection of an antenna of the slot/line coupling type according to the prior art.
Figure 2:
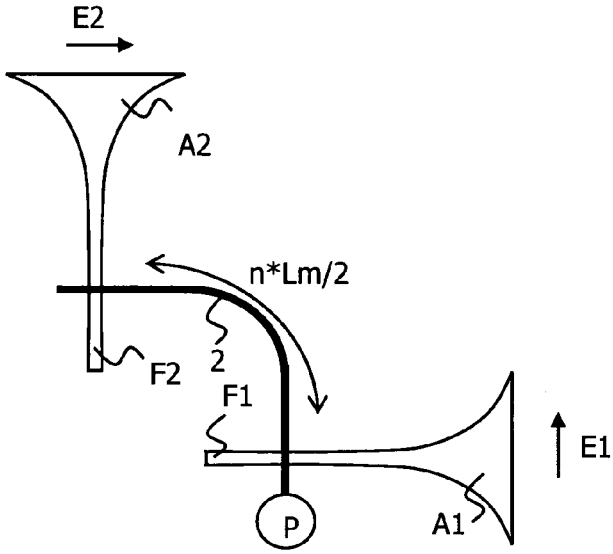
FIG. 2 is a block diagram view of the series connection of two antennas of the slot/line coupling type according to the prior art.
Figure 3:
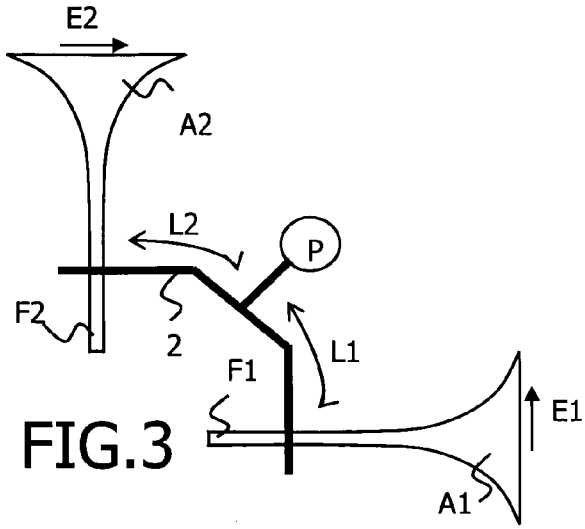
FIG. 3 is a block diagram view of the parallel connection of two antennas of the slot/line coupling type according to the prior art.
Figure 4:
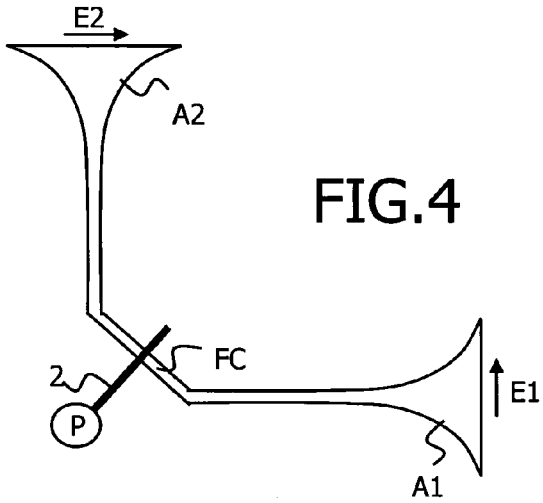
FIG. 4 is a block diagram view of the advantageous parallel connection of two antennas of the common/slot line coupling type according to the prior art.
Figure 5A:
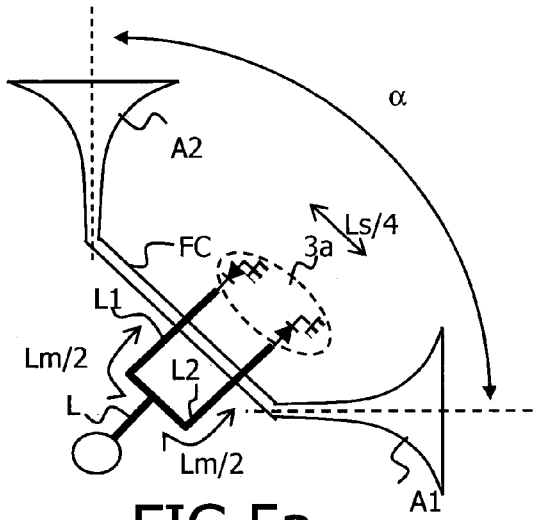
FIGS. 5*a* and 5*b* are block diagram views of connection means of two antennas used in the present invention.
Figure 5B:
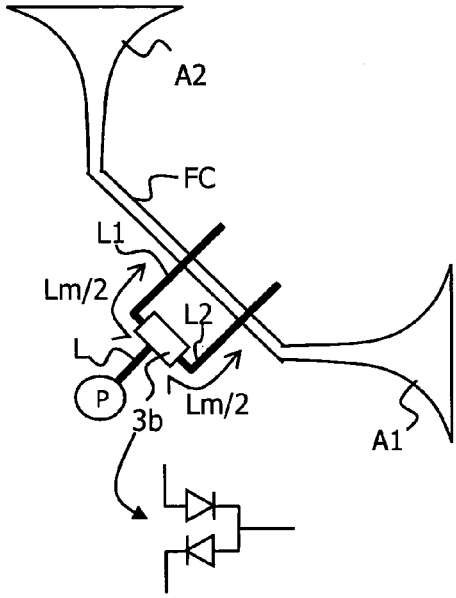

FIGS. 5*a* and 5*b* show a first embodiment of the invention. In these figures, two antennas A1 and A2 are connected and fed by the same line (L1 or L2)/slot FC transitions. According to the position of the lines L1 and L2, linked to a port P, on the slot, a phase difference between the signal E1 sent by A1 and the signal E2 sent by A2 can be defined. This phase difference is due to a difference in distance between the line/slot transition and the antennas A1 and A2.

This enables different patterns to be obtained according to the position of the line/slot transition. Hence, when the angle between the two antennas A1 and A2 is 90°, two distinct radiation patterns are obtained, shown in FIG. 6*b*.

In this figure it is seen that, as the line L1 crosses the slot at equal distance from the antennas A1 and A2, the pattern D1, corresponding to a connection by the line L1, has a null in the axis because the signals sent are of the same amplitude and in phase at the level of the antennas A1 and A2 but recombine negatively in phase opposition along this axis. However, the line L2 is offset by a quarter of the guided wavelength in the slot Ls/4, which enables a phase difference of 90° to be introduced. Hence, a phase difference of 180° is introduced on the signal arriving at the antenna A2 in comparison with the signal arriving at the antenna A1. The radiation sent by the two antennas thus recombines constructively along the axis. Hence, the pattern D2, corresponding to the line L2, no longer has any null along the axis.

FIGS. 5*a* and 5*b* differ by the implementation of the switching device 3 between the two lines L1 and L2. The switching device enables the connection of one line to be switched to another one and, consequently, obtain a structure with a diverse radiation pattern.

In FIG. 5*a*, the switching device 3*a* includes diodes at the end of lines L1 and L2 to authorize the coupling on a line at the same time that it is forbidden on the other.

In FIG. 5*b*, the switching device 3*b* between the two lines L1 and L2 includes a discrete or integrated switch, for example an SPDT (Single Port Double Through).

It will be noted that in the embodiment shown in FIG. 5, one of the lines is centred on the axis of symmetry of the antennas, the other line being off-centre. However, it is also possible that such connection lines are both off-centre and placed at different distances from the antennas. This particularly enables the phase difference introduced between two antennas in a device according to the invention to be controlled and therefore to control the global radiation pattern.

The concept of diversity of radiation patterns was validated in simulation for several values of the angle $\alpha$, with the device shown in FIG. 5. The results in terms of radiation pattern are given in FIG. 6. It emerges that irrespective of the angle between the antennas, an efficient diversity is found with radiation nulls at the locations of the radiation maximas when the connection line is offset. The shape and location of the maximas and nulls depend on the distance and angle between the antennas. This geometric phase difference is added to the electrical phase difference. This effect, specific to the invention, enables the device to be dimensioned in order to obtain the required patterns.

Figure 7A:
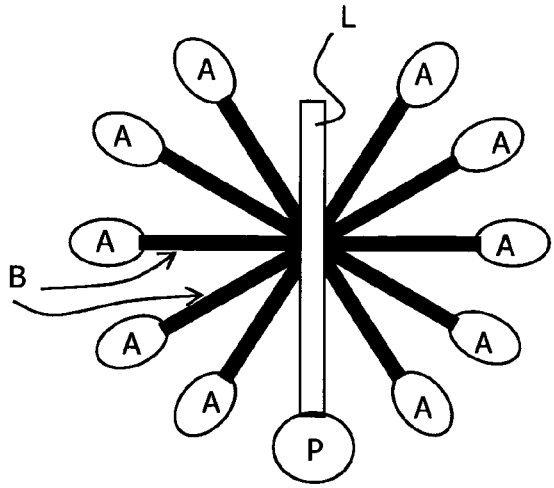
FIGS. 7*a* and 7*b* show a case of a radiating device with 2N antennas and a corresponding circuit diagram.
Figure 7B:
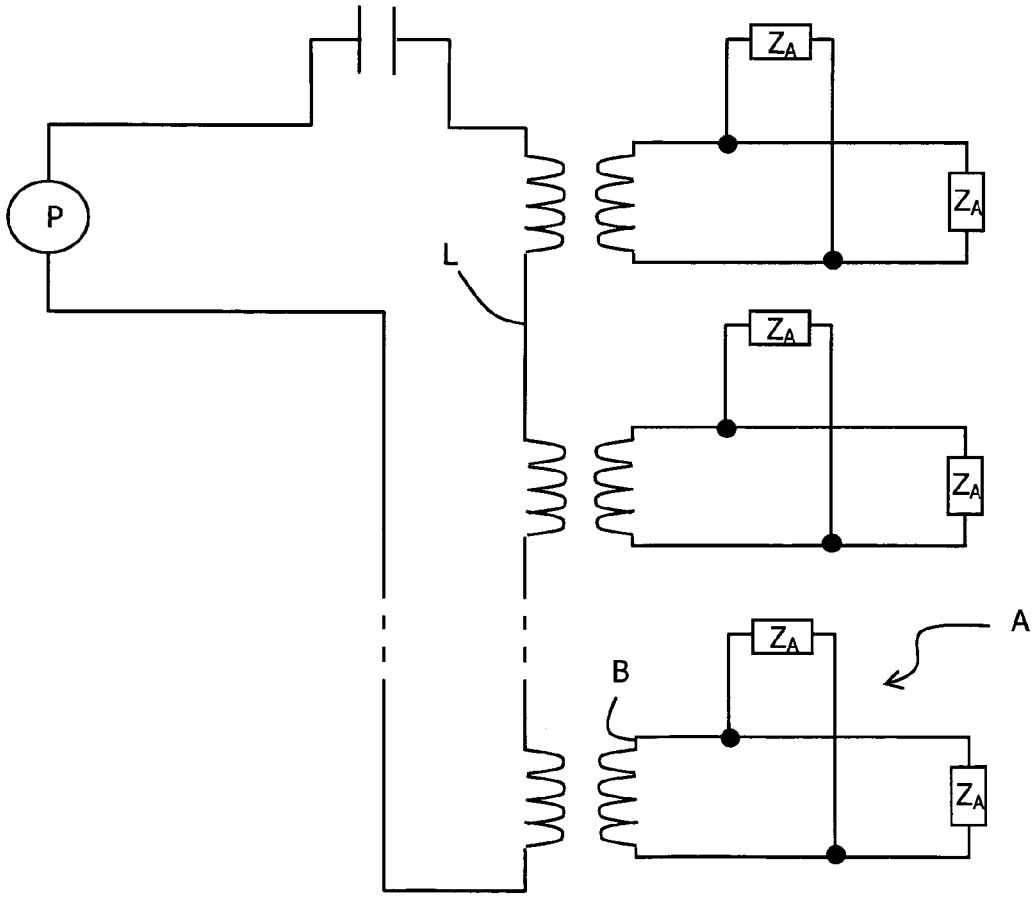
Figure 8:
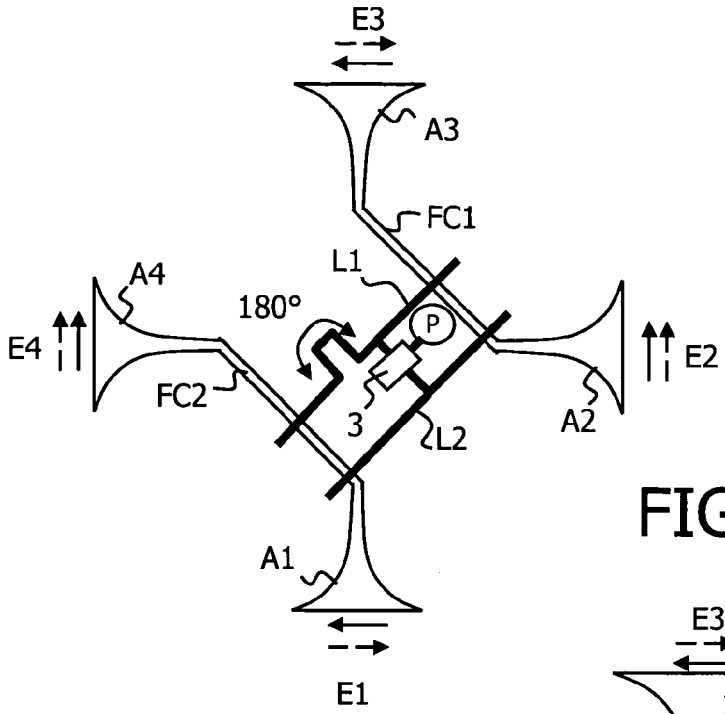
FIG. 8 is a block diagram view of an embodiment of the invention with two pairs of antennas.

It will be noted that the transition between a line, for example, microstrip and several slots operates correctly. When two antennas are combined on the same slot and are connected by the same line, this results, from the point of view of the electrical diagram, in putting the antenna impedances in parallel. As shown in FIG. 7*a*, when the number of antennas A is increased, the common slot comprises branches B toward which the electromagnetic signals are coupled, several branches B intersecting at the same place at the level of the line L/common slot transition constituted by the branches B. From the point of view of the circuit diagram shown in FIG. 7*b*, this results in putting the impedances $Z_A$ of the antennas A in series. It is therefore possible to multiply the number of antennas connected by a same line L. One embodiment of the invention multiplying the number of antennas of the radiating device is shown in FIG. 8. Four antennas A1, A2, A3, A4 are grouped in pairs, respectively (A1, A4) and (A2, A3), with a common slot, respectively FC1 and FC2. Such a structure, presenting a parallel connection has a good bandwidth and therefore enables operation at diverse frequencies. A switching device 3 is constituted by a switch, for example comprising two diodes, as shown in FIG. 5*b*, and enabling the slots FC1 and FC2 to be connected to one or other of the lines L1 and L2. The switching device 3 is connected to a connection port that is itself connected to a signal feed and/or processing means.

When the connection switches from line L1 to line L2, the signal E3 present in the antenna A3 is phase shifted by 180° with respect to signal E2 present in antenna A2, represented by the change in orientation of the vector E3 on FIG. 8. When the phase difference introduced is 180°, the orientation of the signal E3 in the antenna A3 then changes, as shown in FIG. 8.

The behaviour of the electromagnetic signals is similar, all things being the same, for the antennas A4 and A1. However, in order to obtain phase changes that enable the genuine observation of radiation pattern diversity, a fixed phase difference of 180° is realised on line L1, next to the antenna pair A1 and A4.

Figure 9:
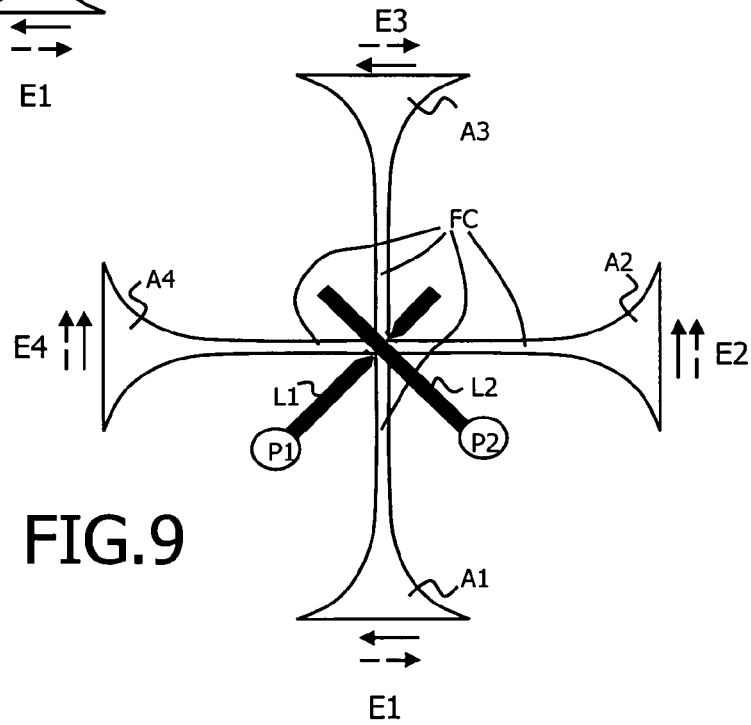
FIG. 9 is a block diagram view of an embodiment of the invention with a number N=4 antennas.
Figure 10:
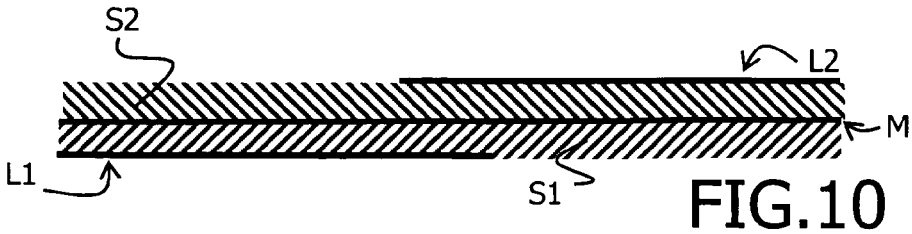
FIG. 10 is a section of a radiating device as proposed in FIG. 9.

Another embodiment enabling the number of antennas to be increased is shown in FIG. 9. In this figure, four antennas A1, A2, A3, A4 are connected by their common slot FC in the form of a four-branched star. As shown in FIG. 10, they are, for example, engraved in a ground plane M. A first feeder line L1 is arranged above the ground plane M, on a first substrate S1, and the second feeder line L2 is arranged above the ground plane M, on a second substrate S2. Hence the lines are insulated from each other. This structure is advantageous where a low-cost multi-layer substrate S is used, for example the FR4. This type of substrate can particularly be used to realise RF boards.

Such a multi-layer substrate enables antennas and the connection means to be realised on the same substrate without using additional components between the two.

The radiating device thus obtained has an operating bandwidth for matching as well as in transmission, with an equal distribution of energy between the antennas. Owing to the excellent intrinsic insulation of the connections, this embodiment does not require any additional components to provide the insulation between the lines. A good diversity of radiation is obtained, the radiation patterns obtained for each of the lines being complementary.

Figure 6A:
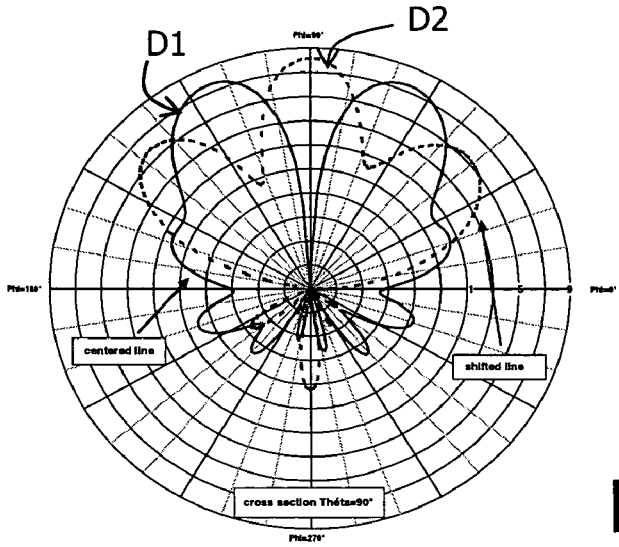
FIGS. 6*a*, 6*b* and 6*c* show the radiation patterns of the device of FIG. 5 as a function of the angle between two antennas.
Figure 6B:
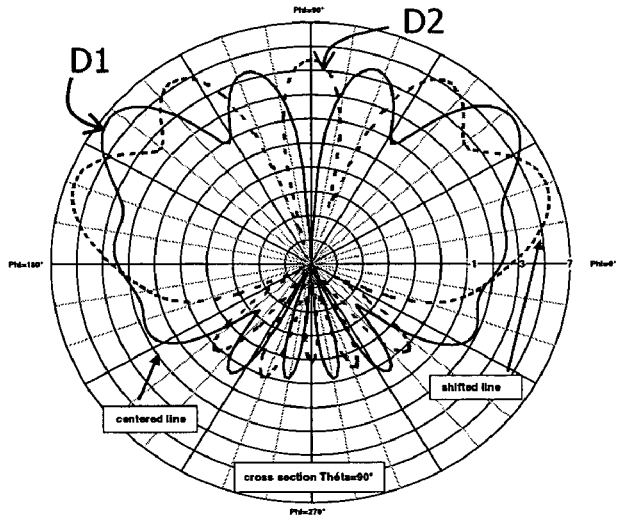
Figure 6C:
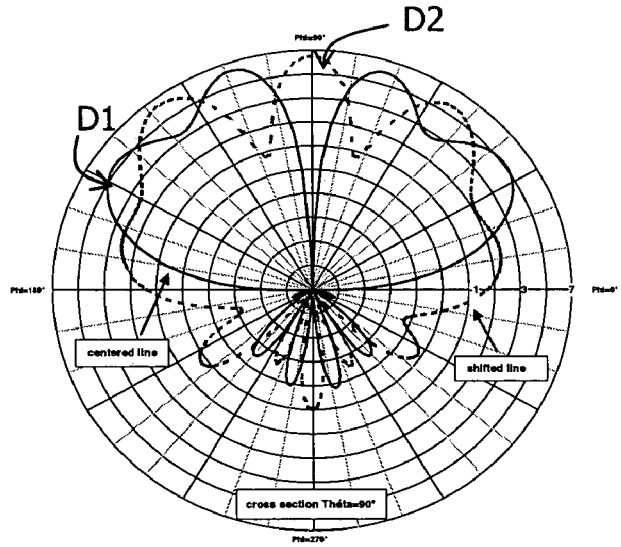
Figure 11A:
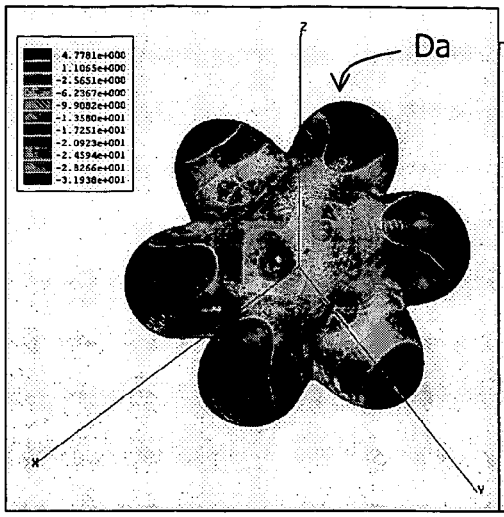
FIG. 11 is a relief view of the radiation patterns obtained with a radiating device as shown in FIG. 9.
Figure 11B:
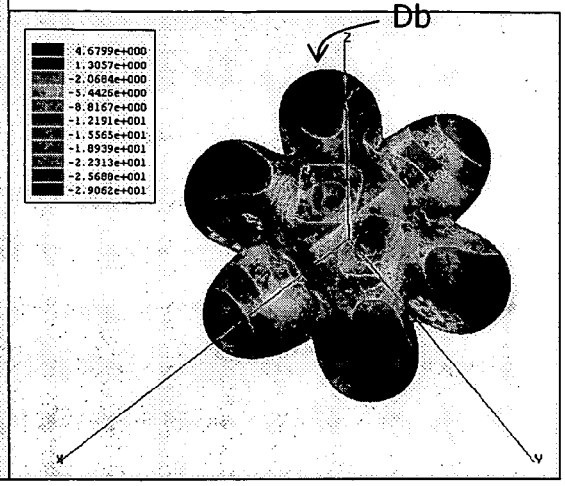

FIG. 11 shows the radiation patterns Da and Db in a relief view of the quadruple antenna structure, shown in FIG. 9. It is noted that these two patterns Da and Db obtained, each for one of the lines, respectively L1 and L2, are different and show excellent complementarity. Hence, by switching from one line to another, a dynamically configurable radiation is available. Such a complementarity of patterns is also seen in FIG. 6 at two dimensions but only for two antennas.

The invention is not limited to the embodiments described and those in the profession will recognise the existence of diverse embodiment variants such as, for example, the multiplication of antennas connected according to the principle of the invention.

What is claimed is:

1. A radiating device intended to receive and/or transmit electromagnetic signals comprising at least two means for receiving and/or transmitting electromagnetic signals of the slot connected antenna type and having a common slot, and connection means for connecting at least one of the said means for receiving and/or transmitting to processing means of electromagnetic signals, wherein the connection means include two connection lines connected to the processing means, the two lines terminated by an open circuit being coupled electromagnetically with the common slot of the two means for receiving and/or transmitting so as to enable a phase difference to be introduced between the electromagnetic signals of the two means for receiving and/or transmitting when the connection is switched from one line to the other by means of a switching device present on the connection lines.

2. The radiating device according to claim 1, wherein the means for receiving and/or transmitting are grouped in pairs with a common slot, the connection of a pair being realized by means of two lines placed so as to cut the common slot at different distances from the axis of symmetry of the pair of means for receiving and/or transmitting so as to enable a phase difference to be introduced between the means for receiving and/or transmitting the pair.

3. The radiating device according to claim 2, wherein the pairs are grouped by group of two pairs connected by the same two connection lines, a fixed phase difference having been introduced on one of the lines for the connection of one of the two pairs.

4. The radiating device according to claim 1, wherein the means for receiving and/or transmitting are grouped by groups of N means of reception and/or transmission by connecting the N slots to a common slot having N branches, connection lines, insulated from each other, forming N' branches centred on the common slot and arranged in an offset manner in rotation with respect to the branches of the common slot.

5. The radiating device according to claim 4, wherein N is an even number.

6. The radiating device according to claim 4, wherein N'=N.

7. The radiating device according to claim 1, wherein the means for receiving and/or transmitting are end-fire arrays regularly spaced around a central point.

8. The radiating device according to claim 1, wherein the connection lines are constituted by microstrip lines or coplanar lines.

9. The radiating device according to claim 1, wherein the switching device includes at least one diode.

10. The radiating device according to claim 1, wherein the switching device is a discrete switch for selectively activating one or other of the connection lines.

11. The radiating device according to claim 1, wherein the switching device is an integrated switch for selectively activating one or other of the connection lines.

* * * * *